United States Patent [19]

Norden

[11] Patent Number: 4,775,324

[45] Date of Patent: Oct. 4, 1988

[54] ELECTRICAL TERMINAL ASSEMBLIES

[75] Inventor: Alexander R. Norden, New York, N.Y.

[73] Assignee: Connectron, Inc., Laurence Harbor, N.J.

[21] Appl. No.: 458,831

[22] Filed: Jan. 18, 1983

[51] Int. Cl.[4] ..... H01R 9/24

[52] U.S. Cl. ..... 439/709; 439/712

[58] Field of Search ..... 339/198 R, 198 S; 439/709, 712, 713, 715, 718, 720–722

[56] References Cited

U.S. PATENT DOCUMENTS

| | | | |
|---|---|---|---|
| 2,360,304 | 10/1944 | McLoughlin et al. | 339/198 S |
| 2,450,050 | 9/1948 | Macy | 339/198 S |
| 2,735,994 | 2/1956 | Obszarny | 339/198 R |
| 3,152,219 | 10/1964 | Murray et al. | 339/198 R |
| 3,253,251 | 5/1966 | Norden | 339/198 GA |
| 3,904,266 | 9/1975 | Fitzpatrick | 339/198 R |
| 4,176,904 | 12/1979 | Obuch | 339/198 S |
| 4,195,194 | 3/1980 | Kuster et al. | 339/198 R |

FOREIGN PATENT DOCUMENTS

| | | | |
|---|---|---|---|
| 110594 | 4/1964 | Czechoslovakia | 339/198 R |
| 1147226 | 5/1958 | France . | |
| 2432779 | 4/1980 | France | 339/198 R |
| 433474 | 9/1967 | Switzerland | 339/198 R |
| 2042833 | 9/1980 | United Kingdom | 339/198 R |

*Primary Examiner*—Gil Weidenfeld
*Assistant Examiner*—Gary F. Paumen

[57] ABSTRACT

The disclosed embodiments represent novel compact terminal blocks and novel compact side-by-side assemblies of an elongated terminal block, a wiring channel at one side, and an electric circuit structure at its opposite side. Current paths slant prominently in traversing the terminal block, including slanted end portions of wiring from the wiring channel and slanted conductors in the terminal block. Corner recesses in a first side of the terminal block admit the slanted end portions of wiring from the wiring channel. Corner recesses in the second side of the terminal block opposite the first side contain projecting terminals for plug-in connection to companion plug-in terminals of an electric circuit structure or for soldered connection to conductors of the electric circuit structure, or the second-side recesses (in another embodiment) admit slanted end portions of wiring from a second wiring channel to the terminal block's connecting devices.

16 Claims, 3 Drawing Sheets

ELECTRICAL TERMINAL ASSEMBLIES

The present invention relates to apparatus for interconnecting parts of electrical circuit equipment.

In a widely standardized form of construction, an elongated terminal block or a row of terminal blocks has a wiring gutter along one of its sides and circuit apparatus along its opposite side. A series of connecting devices in the terminal block(s) connect wires in the wiring gutter to terminals of the circuit apparatus.

In typical terminal blocks of this kind, a row of connecting devices have at least one screw fastener for clamping an end of a wire extending from a wiring gutter. A well-known form of such connecting devices and of such screw fasteners is shown in my U.S. Pat. No. 3,253,251.

In a known application, terminal blocks are used to connect control-circuit modules to external wirring via wiring gutters. Several sets of circuit modules and companion terminal blocks are often mounted side by side in a control assembly. Each circuit module has terminals that are connected to connectors of a terminal block which are connected, in turn, to wires in a wiring gutter. The assembly must provide easy, orderly access to each connecting device of the terminal block for fabrication initially and for later testing and servicing. Typically, the terminal block in a low-voltage and low current application occupies a width of 1¼ inches between the circuit module and the wiring gutter. The wiring gutter must also be made amply wide for convenient access when a wire from the wiring gutter is to be inserted into a screw-fastener terminal.

In another application, plural elongated terminal blocks or rows of terminal blocks are mounted as spaced-apart units in a junction box. The spaces at opposite sides of each terminal block (between each terminal block and the next) form wiring channels. As in the foregoing example of modular control equipment, each terminal block and the wiring channels at opposite sides of each terminal block in a junction box have been made relatively wide to allow for easy manipulation of the wire ends and for bends in the wire to lie in the wiring channel.

There may be requirements of separation between each connecting device and its neighbor(s) in the terminal block to meet voltage breakdown specifications in case significantly high voltage is involved. This consideration is commonly met by providing raised interphase barriers on the insulating structure of the terminal block, or by recessing the connecting devices in the molded insulation. My U.S. Pat. No. 3,253,251 shows staggering of each connecting device and its neighbors, as yet another means for providing ample surface creep distances between neighboring connecing devices.

In each of these examples of assembled electrical equipment, the width of each terminal block plus the wiring channel at one side of each terminal block and the electrical circuit structure at the opposite side result in relatively bulky apparatus.

An object of the present invention resides in providing electrical apparatus having a novel relationships between an elongated terminal block and the equipment(s) interconnected by the terminal block for more efficiently utilizing the space that the entire apparatus occupies.

More specifically, an object of the present invention resides in providing novel elongated terminal blocks that are adapted to form part of novel compact equipment, wherein the width of the terminal block is sharply reduced and wherein the space required by the entire apparatus is further reduced.

Yet another object of the invention resides in providing novel compact equipment that includes elongated terminal blocks, without detracting from voltage breakdown properties of such equipment and without hampering—if not actually facilitating—wiring of the equipment.

In the illustrative embodiments of the invention detailed below, wires connected to novel elongated terminal blocks extend into a wiring channel that can be narrower than heretofore in a structure that remains easy to wire. Screw-fasteners of the terminal block receive end portions of wires from the wiring channel, forming a prominently slanted angle (e.g. 45°) with the length of the terminal block. Connection devices extending through the novel terminal blocks form current paths that slant prominently in relation to the terminal block, the current paths extending generally in line with the end portions of the wiring.

The overall reduction in width is attributable to a number of factors. The slant-angle entry of the wires from the wiring channel into the wire-fastener terminals reduces the width of the wiring channel required to contain a bend in the wire extending outward from the terminal block and then along the wiring channel. The same slant-angle of entry affords easy access for inserting wire ends into the terminal block even where the wiring channel is narrow. The slant-angle conducting path through the elongated terminal block itself contributes a further reduction in the required width of the equipment. An insulating body of the novel terminal blocks has a series of corner recesses that impart extended surface creep distance between each connecting device and its neighbors, to minimize or eliminate interphase barriers and the space requirements thereof. Where the terminal block is used to connect wires in a wiring channel to an electric circuit structure, for promoting compactness the terminal block has solder posts or plug-in contacts projecting into recesses in its insulator and these projections are connected to terminals of the circuit structure in or adjacent to those recesses.

In each form of the novel apparatus described below, each connecting device of the terminal block has a screw fastener especially a screw-actuated box-clamp of the kind in my above-mentioned U.S. Pat. No. 3,253,251. Ideally the connecting device including its wire fastener is contained in the insulating body of the terminal block. In one of the described embodiments of the invention, the connecting devices have screw fasteners at their opposite ends and there are wiring channels along opposite sides of the terminal block. The connecting devices and the recesses that admit wire ends to the screw fasteners from the wiring channels create a pattern of parallel current paths traversing the terminal block at a prominently slanted angle.

In each of the embodiments of the invention described in detail below, there is a side-by-side assembly of an elongated terminal block, a wiring channel along one side, and an electric circuit structue at the opposite side of the terminal block. There is a considerable reduction in the overall width as compared with conventional equipment of the same kind, yet all of the usual properties are retained. Moreover, the slanting entry of the wire ends from the wiring channel into the terminal block facilitates insertion and removal of wire ends.

The nature of the invention, including the foregoing and other objects and novel features, will be more fully appreciated from the following detailed description of novel electrical apparatus shown in the accompanying drawings.

Figure 1:
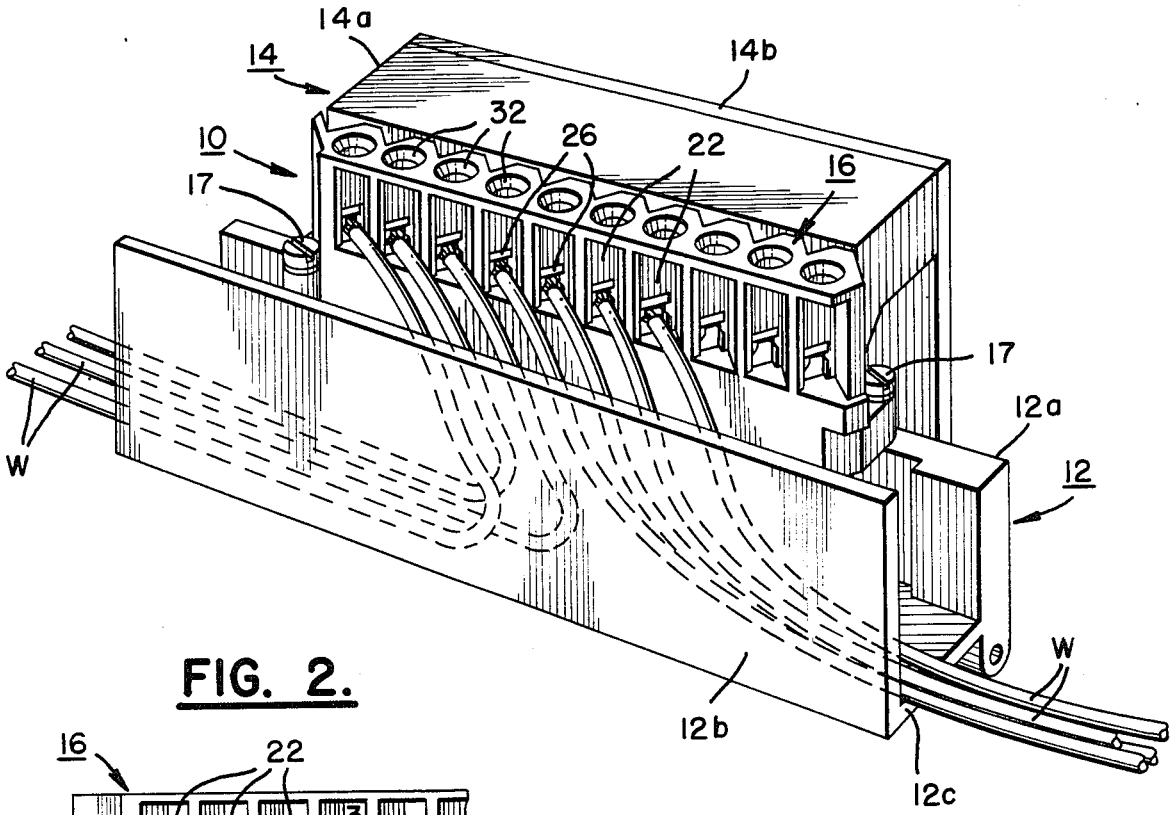
FIG. 1 is a perspective of novel electrical apparatus embodying various features of the invention.
Figure 3:
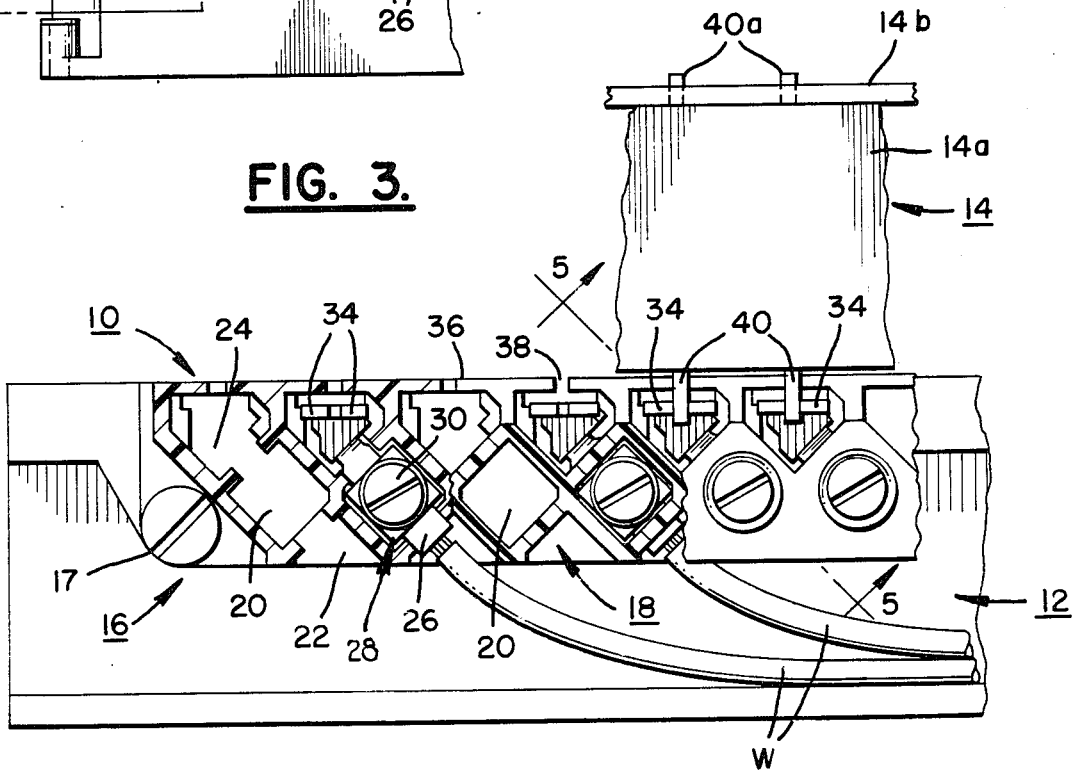
FIG. 3 is an enlarged fragmentary plan view of the apparatus of FIG. 1, portions being broken away and shown in cross-section along the planes 3—3 in FIG. 2.

Referring now to the drawings, the apparatus of FIGS. 1 and 3 comprises a terminal block 10, a wiring gutter 12 and a modular circuit unit 14 comprising a plug-in terminal strip 14*a* and a printed circuit board 14*b* bearing components (not shown) under the terminal strip, in the space between the printed circuit board and the back wall 12*a* of wiring gutter 12. In practical equipment, this apparatus and a series of like three-part assemblies are assembled side-by-side in a control center.

Wiring gutter 12 is at one side of, and below, terminal block 10. Wiring gutter 12 has side walls 12*a* and 12*b* and a bottom 12*c*, defining a channel in which wires W extend generally parallel to terminal block 10.

Terminal block 10 includes an elongated body 16 of molded electrical insulation that is secured by screws 17 to the top edge of wall 12*a* of the wiring gutter.

Figure 5:
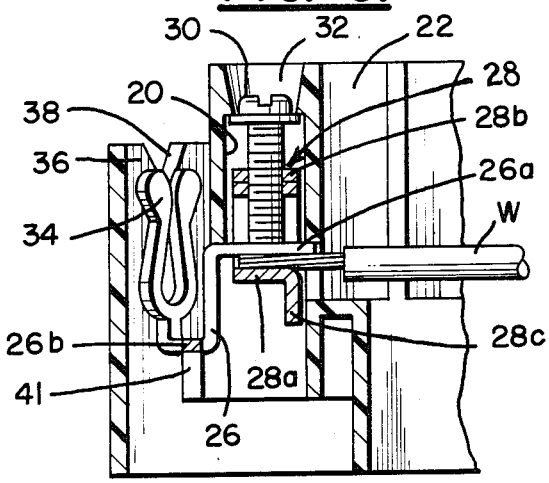
FIG. 5 is an enlarged view of the terminal block in FIGS. 1-4 as viewed at the plane 5—5 in FIG. 3.

As best seen in FIG. 3, a regularly spaced series of passages 18 extend slantwise at about 45° through body 16. Each passage is divided into three parts: a central cavity 20, first corner recesses 22 in a first side of body 16 and second corner recesses 24 in the second side of body 16 opposite said first side. A two-terminal connecting device in each passage (see FIG. 5) includes a connector strip 26 as of copper. One end portion 26*a* of strip 26 serves as a terminal for a wire W. A four-walled collar or clamp 28, formed of a sheet-metal strip, sides up and down in cavity 20. Bottom wall 28*a* of the clamp drives wire W against the connector strip 26. The top screw-threaded wall 28*b* of the clamp is formed of overlapped end portions of the strip that forms clamp 28. Screw 30 has a flanged head that is captive under an overhang at the top of insulating body 16. The screw head is accessible for endwise engagement and operation from the top of body 16 through hole 32 by a suitable tool, ordinarily a screw driver. The screws are upright in the sense that their axes are normal to the top of block 16, as shown in FIG. 5. Holes 32 are formed in the top surface of body 16, a surface that extends side-to-side between the above-mentioned first and second sides of body 16. The lower end of screw 30 rests on strip 26, and it bears firmly against strip 26 when the screw tightens the bottom wall 28*a* of the collar against wire W.

When clamp 28 is lowered there is a free space between connector end portion 26 and lower wall 28*a* to receive a wire W. Whenever clamp 28 is raised by screw 30 before a wire has been inserted, depending lip 28*c* blocks entry of a wire below the bottom wall 28*a* of the collar. Screw 30 and collar or clamp 28, with conductor portion 26*a*, thus constitute a screw fastener or wire fastener for wire W at one end of connector strip 26. In this embodiment, screws 30 are in line and their axes are parallel and in a common plane parallel to the mutually opposite first and second sides of body 16 in which recesses 22 and 24, respectively, are formed. Those recesses have surfaces that slant alternately at about 45° to respective opposite first and second sides of body 16, zig-zag or accordion-like along those elongated side surfaces. Those recess-defining surfaces are upright, being parallel to the screw axes and perpendicular to the side-to-side top surface of body 16.

The end portion of connector strip 26 remote from portion 26*a*, i.e., at a side of wire fastener 26*a*/28/30 nearest said second side of the body 16, a terminal is formed as a two-jaw female plug-in contact 34, angled in relation to strip 26 (FIG. 3) to be parallel to wall 36 of the terminal block 10. A slot 38 in wall 36 is aligned with the slot between the jaws of each plug-in contact 34, respectively. Connector strip 26, screw-fastener 28, 30 and plug-in contact 34 constitute one of a row of connecting devices that occupies (usually) each passage 18. These connecting devices therefore extend slantwise through body 16 of insulation.

Figure 2:
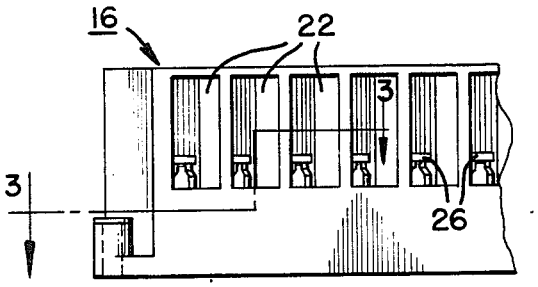
FIG. 2 is a fragmentary view of the terminal block in the apparatus of FIG. 1 as viewed upward and to the right in FIG. 1.
Figure 4:
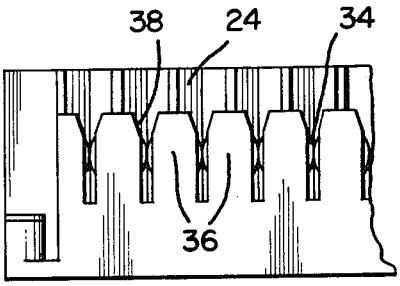
FIG. 4 is a rear view of the terminal block in FIG. 2.

At its screw-fastener end 26*a*, connector strip 26 emerges into corner recess 22 (see FIGS. 1-3). The zig-zag surfaces forming the successive corner recesses represent an extended surface creep distance from each connector strip 26 to the next. Correspondingly, the corner recesses 24, supplemented by slotted wall 36 (FIG. 4), represent extended surface creep distances between neighboring connector devices. These extended surface creep distance, serve to prevent breakdown between neighboring conductors 26 when significantly high voltage is involved. The extended surface creep distances are developed without resort to raised interpole barriers of insulation. These surface creep distances could be extended by interphase barriers, if required, for higher voltage application.

Each female plug-in contact 34 grips a male plug-in contact 40 of strip 14. The opposite end 40*a* of contact 40 is soldered to a conductor forming part of printed circuit-board 14*b*.

Terminal block 10 is fixed to wiring gutter 12 that provides an elongated wiring channel parallel to the elongated terminal block. Wires W enter corner recesses 22 and the connecting devices 26, 28 at a prominently slanted angle, e.g. 45°, relative to the length of the terminal block. This relationship makes possible a considerable reduction in width of the equipment 10-12-14 both because terminal block 10 itself can be made quite narrow due to the slantwise disposition of the connecting devices 26, 28, 34 and because there is no need for a right-angle bend in the wire emerging from the terminal block and entering the wiring channel. At the opposite side of the terminal block, paired plug-in contacts 34 and 40 form connections in corner recesses 24, promoting a distinctively slender or narrow terminal block. Contacts 40 move down and up along corner recesses 24 when modular circuit unit 14 is being installed and removed. In this narrow assembly, wire fasteners **26*a*/28/30 are aligned with each other adjacent one side of the elongated block of insulation, and terminals 34 are disposed at the side of the respective wire fasteners nearest the opposite side of the body of insulation. Because of the slantwise disposition of connecting device 26*a*/28/30-26-34, each terminal 34 is offset substantially in relation to its related wire fastener 26*a*/28/30 along and across body 16. Moreover (see FIG. 3) each terminal 34 is also offset in relation to the wire fastener of the succeeding connecting device, so that the wire fasteners 36*a*/28/34 and the terminals 34 are staggered in alternating succession along body 16**.

In an example, terminal block 10 is only 9/16-wide where a comparable terminal block of conventional construction is 1 ¼ inches wide. The slant disposition of the connecting devices 26, 28, 34 contributes to this result. The zig-zag surfaces that define the two rows of corner recesses is a contributing factor, particularly where voltage break-down may be of concern. As one detail of this narrowed construction, corner recesses 22 are directly opposite corner recesses 24, and where one corner recess 22 admits a wire W to the screw fastener 28, 30 at one terminal of one connecting device 26, 28, 30, 34, the directly opposite corner recess 24 contains the second terminal 34 of a neighboring connecting device, except at the ends of block 10.

Member 26 has laterally projecting wings **26*b*. Molded body 16 has a pair of ledges 41 that are spaced apart to admit the narrow portion of member 26 adjacent wings 26*b* during installation. Each connecting device 26, 28, 30, 34 assembled into body 16 from below. As the connecting device is being installed, portion 34 is pressed against the left-hand surface of the cavity and the connecting device is raised until wings 26*b* clear ledges 41. Then member 26, 34 is shifted to the right until wings 26*b* slide onto ledges 41. During this motion, the right-hand extremity of strip 26 (as seen in FIG. 5) moves into a T-shaped opening in body 16. Edge portions of the strip are then supported by the ledges that define the horizontal portion of the "T" shape, while the lower, vertical portion of the opening admits wire W. Strip 26 becomes gripped at its edges by body 16, preventing it from shifting to the left after it has been installed in the position shown. Wings 26*b* and ledges 41 support plug-in contact 34 against the downward pressure that develops as contact 40** is being plugged-in.

Figure 6:
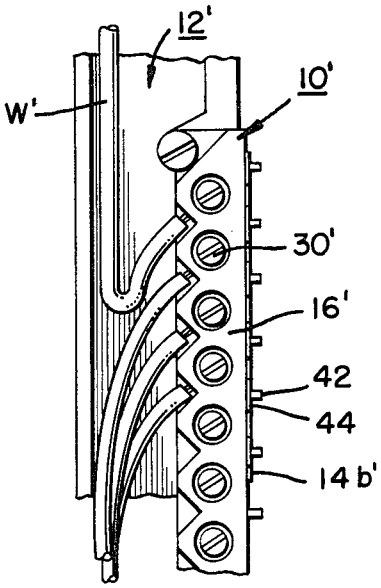
FIG. 6 is a plan view of a second embodiment of the invention including novel aspects of the embodiment of FIGS. 1-5 and certain further novel aspects.
Figure 7:
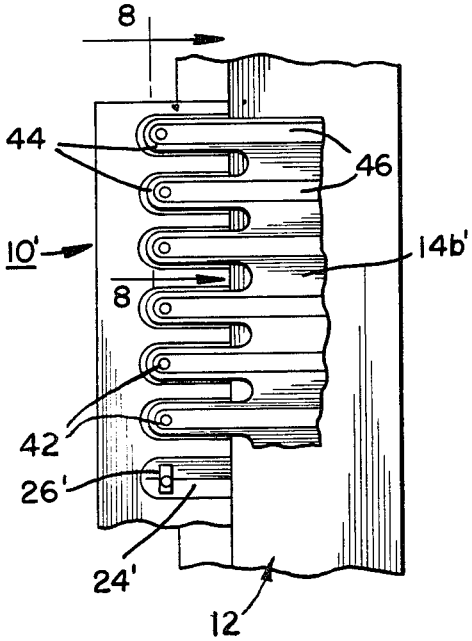
FIG. 7 is an elevation of the second embodiment, as seen from the right of FIG. 6.
Figure 8:
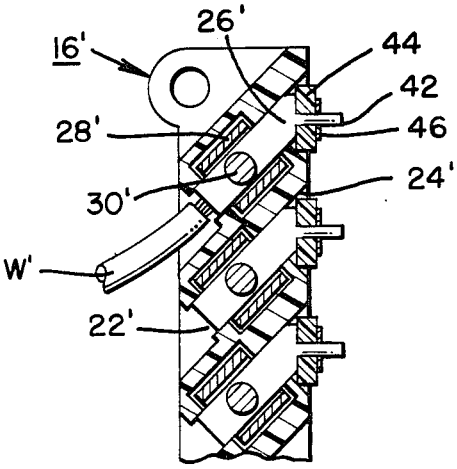
FIG. 8 is an enlarged fragmentary cross-section of the terminal block in the equipment of FIGS. 6 and 7 as seen at the plane 8—8 in FIG. 7.

In a modification, where the plug-in feature of FIGS. 1–5 is not required, the construction in FIGS. 6–8 may be used. With noted exceptions, the construction of FIGS. 6–8 is the same as in FIGS. 1–5. Primed numerals are used in FIGS. 6–8 to designate parts corresponding like parts in FIGS. 1–5.

Terminal block 10' is fixed to a wall **12*a*' of wiring gutter 12' and to printed circuit board 14*b*'. Screws 30' and clamping collars 28' form screw fasteners or wire fasteners for securing wires W' to the connecting strips 26'. Posts or terminals 42 are integral extensions of conducting strips 26'. The wire fasteners are aligned with each other along body 16 adjacent a first side of body 16' and each terminal 44 is at a side of its related wire fastener nearest the second side of body 16'** opposite said first side of that body.

Fingers 44 of printed circuit board **14*b*' bear conductive strips 46. These fingers are partly received in corner recesses 24' of the terminal block . Posts 42 extend through holes in fingers 44 and are soldered to conductive strips 46**.

As is readily apparent, the construction involves a remarkably narrow terminal block 10'. This is due to several contributing factors. Its own connecting devices extend through it at a prominently slanted angle, e.g. 45°, and wires W' extend from it at a like slant angle in entering the wiring channel. Additionally, corner recesses 24' receive portions of the printed circuit structure to which the connecting devices of the terminal block are connected. Because of the slant disposition of the connecting devices, each terminal 44 is offset from its related wire fastener along body 16. And as seen in FIGS. 6 and 8, each terminal 44 of one connecting device is similarly offset from the wire fastener of the next succeeding connecting device, so that the wire fasteners and the terminals are staggered along the insulating body 16.

Certain aspects of the invention embodied in the apparatus in FIGS. 1–5 and FIGS. 6–8 are also utilized in a further embodiment of the invention shown in FIGS. 9–12.

Figure 9:
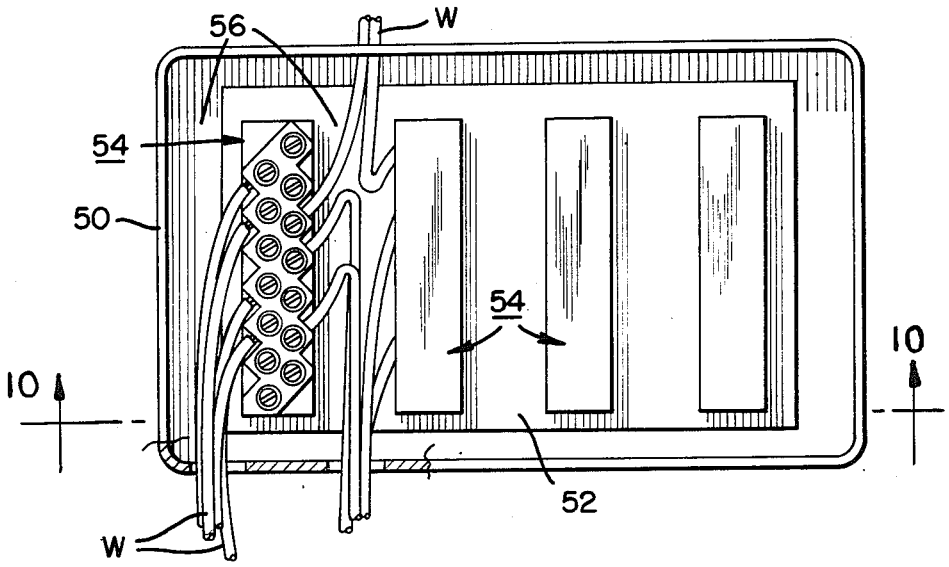
FIG. 9 is a top plan view, partially diagrammatic, of a third embodiment of certain novel aspects of FIGS. 1-8 and additional novel aspects.
Figure 10:
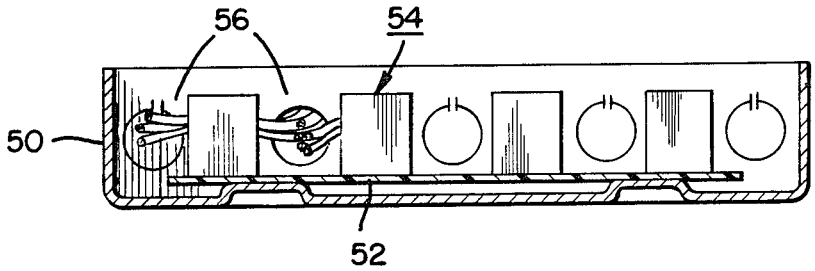
FIG. 10 is a cross-section of the apparatus of FIG. 9 at the plane 10—10 therein.

FIGS. 9 and 10 show a junction box, including a sheetmetal box 50 and a mounting pan 52 secured thereto. A series of terminal blocks 54 are fixed to mounting pan 52. (Most of the terminal blocks are represented diagrammatically.) Narrow wiring channels 56 are defined by the spaces between successive terminal blocks 54 and between each end wall of box 50 and a terminal block 54 at each end of the series of terminal blocks.

Figure 11:
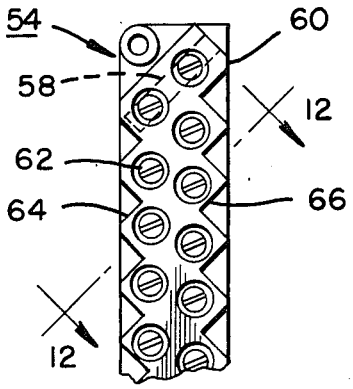
FIG. 11 is a top plan view of one of the terminal blocks in FIGS. 9 and 10.
Figure 12:
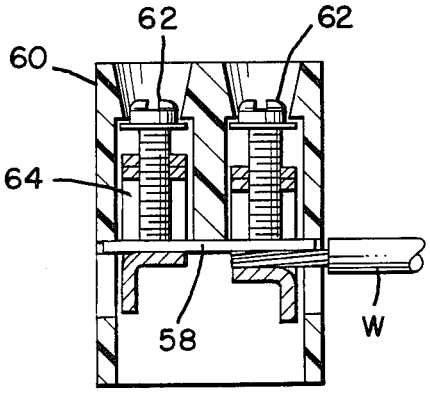
FIG. 12 is an enlarged cross-section of the terminal block of FIGS. 8-10, as seen at the plane 12—12 in FIG. 11.

Details of the terminal blocks 54 appear in FIGS. 11 and 12. Each conducting strip 58 as of copper extends at about 45° to the length of terminal block 54 in a passage through body 60 of molded insulation. A captive screw 62 and a sheetmetal collar or clamp 64 form a screw fastener at each end portion of strip 58. Each such screw fastener 62, 64 and its relation to the insulating body 60 and to conducting strip 58 are the same as that which was described in detail above in relation to FIGS. 3 and 5. Accordingly, each end of strip 58 is supported by ledges defined by the upper portion of a T-shaped opening in the molded body, and the lower portion of the opening admits a wire W. The edges of strip 58 are tightly received in body 60, holding member 58 in place. As in the embodiments of FIGS. 1–5 and 6–8, body 60 has opposite first and second sides and a side-to-side top surface, and recesses are formed in the opposite sides of body 60 by pairs of oppositely slanting accordion-like surfaces that are upright relative to the top of body 60. The wire fasteners at the left in FIGS. 9 and 11 are aligned with each other adjacent said first side of body 60, and the respective second wire fasteners of the row of connecting devices constitute terminals disposed at a side of the respective first wire fasteners nearest said second side of body 60. Due to the slant disposition of conductors 58, each second wire fastener is offset along body 60 in relation to its respective first wire fastener. Moreover, each first wire fastener (at the left, FIGS. 9 and 11) is offset along body 60 in relation to the second wire fastener (at the right, FIGS. 9 and 11) of the next succeeding connecting device, so that the succession of first and second wire fasteners are staggered along body 60.

The foregoing illustrative embodiments of the invention in its various aspects are amenable to varied application and modification by those skilled in the art. Consequently, the invention should be construed broadly in accordance with its true spirit and scope.

What is claimed is:

1. Electrical apparatus including a terminal block having a row of connecting devices and a relatively elongated and slender body of insulation having opposite first and second sides and a side-to-side top surface and having insulating barrier portions separating the successive connecting devices of the row from each other, means at said first side of said elongated body of insulation defining a long and narrow wiring channel parallel thereto, and an electric circuit structure at and extending along said second side of said elongated body of insulation, said connecting devices comprising wire fasteners aligned with each other along said elongated body and disposed adjacent said wiring channel for admitting end portions of wires in the wiring channel, said wire fasteners including screws having parallel axes and disposed for endwise engagement from the top of the body of insulation by an operating tool, said connecting devices having terminals connected to said wire fasteners, respectively, said terminals being disposed at the sides of the respective wire fasteners nearest said second side of the body of insulation, said wire fasteners and their respective terminals being offset substantially in relation to each other along said elongated body of insulation, said electric circuit structure including connecting elements directly connected to said terminals, respectively.

2. Electrical apparatus as in claim 1 wherein wires from the wiring channel include end portions received in said wire fasteners, respectively, said end portions slanting prominently relative to the wiring channel.

3. Electrical apparatus as in claim 1 wherein said wire fasteners include respective wire-constraining formations disposed at a prominent slant angle to said first side of the elongated body of insulation for receiving correspondingly slanted end portions of wires from the wiring channel.

4. Electrical apparatus including a terminal block having a row of connecting devices and an elongated slender body of insulation having opposite first and second sides and a side-to-side top surface and having insulating barrier portions separating the successive connecting devices of said row from each other, means at said first side of said body of insulation defining a relatively long and narrow wiring channel parallel thereto, and an electric circuit structure extending along said second side of said elongated body of insulation, said connecting devices comprising wire fasteners disposed adjacent said wiring channel and aligned with each other along said body of insulation, said wire fasteners including upright screws having parallel axes and being disposed for endwise engagement by an operating tool from the top of the body of insulation, first and second series of recesses formed in said body of insulation along the first and second sides thereof, respectively, said recesses of the first series being defined by pairs of converging upright surfaces parallel to said screw axes, the surfaces of each pair slanting oppositely at prominent angles relative to said elongated body of insulation and relative to said wiring channel, one surface of each said pair being immediately adjacent to a respective one of said wire fasteners and having an opening for admitting an end portion of a wire that is to extend to the related wire fastener slantwise from the wiring channel and along the other surface of each said pair, the terminal block being thereby adapted for entry of end portions of wires that slant prominently relative to the wiring channel, said connecting devices having terminals connected to said wire fasteners, respectively, said terminals being disposed at the sides of the respective wire fasteners nearest said second side of the body of insulation, said wire fasteners and their respective terminals being offset substantially in relation to each other along said elongated body of insulation, said electric circuit structure including connecting elements aligned with said second series of recesses and having direct connections to said terminals, respectively.

5. Electrical apparatus including means defining an elongated wiring channel and an elongated electrical terminal block extending adjacent to and along said wiring channel, said electrical terminal block including a row of connecting devices and an elongated body of insulation having opposite first and second sides and a side-to-side top surface and said body having insulating barrier portions separating the successive connecting devices in the row from each other, said connecting devices comprising wire fasteners aligned with each other along said elongated body of insulation, said wire fasteners having respective upright screws accessible for endwise engagement by an operating tool from the top of the elongated body of insulation and said screws having parallel axes, said elongated body of insulation being formed for admitting parallel end portions of wires to extend to said wire fasteners from the wiring channel along angles that slant prominently to said elongated body of insulation, said connecting devices having terminals connected to said wire fasteners, respectively, said terminals being disposed at the sides of the respective wire fasteners nearest said second side of the body of insulation, said wire fasteners and their respective terminals being offset substantially in relation to each other along said elongated body of insulation.

6. Electrical apparatus including an electric circuit structure and a terminal block comprising a row of connecting devices and an elongated body of insulation carrying said connecting devices, said body of insulation having first and second sides and a side-to-side top surface, and having insulating barrier portions separating said connecting devices from each other, said electric circuit apparatus extending along said second side of said body of insulation, said connecting devices having wire fasteners aligned with each other along said body of insulation and disposed adjacent said first side of said elongated body including screws upright in relation to said top surface and having parallel axes, said screws being disposed for endwise engagement by an operating tool from the top of the body of insulation, said connecting devices having terminals connected to said wire fasteners, respectively, said terminals being disposed at the sides of the respective wire fasteners nearest said second side of the body of insulation, said wire fasteners and their respective terminals being offset substantially in relation to each other along said elongated body of insulation, and said electric circuit structure having direct connections to said terminals.

7. Electrical apparatus comprising an electrical terminal block having a row of connecting devices and an elongated body of insulation for supporting said connecting devices and insulating them from each other, said body having generally parallel opposite first and second sides and a side-to-side top surface, said sides being essentially free of obstruction that would impede assembly of elongated circuit apparatus to said sides of said body of insulation, said body of insulation including insulation separating the successive connecting devices in said row from each other, said connecting devices including respective wire fasteners aligned with each other along said body of insulation and disposed adjacent said first side of said elongated body of insulation, said wire fasteners having screws whose axes are parallel and upright relative to the top surface of the body of insulation, the screws being accessible endwise by an operating tool from the top of the body of insulation, said body of insulation being formed for admitting end portions of wires via said first side of said body of insulation to said wire fasteners, respectively, along parallel paths that slant at a prominent angle in relation to the elongated body of insulation, said connecting devices including respective plug-in terminals disposed at the sides of said wire fasteners nearest said second side of said body of insulation, said wire fasteners and their respective plug-in terminals being offset substantially from each other along the elongated body of insulation.

8. Electrical apparatus as in any of claims 1, 4, 5, 6 or 7, wherein said wire fasteners and said terminals are staggered in alternating succession along and across the elongated body of insulation.

9. Electrical apparatus as in any of claims 1, 4, 5, 6 or 7 wherein each said wire fastener includes a four-wall sheet-metal wire clamp operable by the relative screw and having upright parallel spaced-apart side walls disposed at a prominent slant angle to said one side of the elongated body of insulation for receiving a correspondingly slanted end portion of a wire.

10. Electrical apparatus including means defining an elongated wiring channel and an electrical terminal block extending along and adjacent to said wiring channel, said electrical terminal block including a row of connecting devices and an elongated body of insulation providing insulating barrier portions separating the successive connectors of the row, said body of insulation having opposite first and second sides and a side-to-side top surface, said connecting devices comprising wire fasteners having respective upright screws whose axes are parallel and which are disposed for endwise engagement by an operating tool from the top of the elongated body of insulation, said terminal block comprising portions defining opposite pairs of upright surfaces between which a wire may be inserted, said pairs of surfaces extending in planes perpendicular to said top surface and slanting at a prominent angle relative to said first and second sides of the body of insulation for admitting a prominently slanted end portion of a wire from the wiring channel to each said wire fastener, and each said connecting device having a respective terminal at the side of the wire fastener nearest the second side of said elongated body and accessible via said second side of the elongated body, said connecting devices having respective conductors between their wire fasteners and their respective terminals extending along parallel paths slanting prominently from side-to-side relative to the elongated body of insulation.

11. Electrical apparatus as in claim 10, wherein each said wire fastener is of the type having a four-sided sheet-metal clamp cooperable with an end portion of a related one of said conductors, two sides of the clamp providing said opposite surfaces between which said wire portion may be inserted, the related screw being threaded through a third side of the clamp and being engageable with said conductor end portion, and the fourth side of the clamp being movable against an inserted wire portion when the screw is tightened.

12. Electrical apparatus as in claim 10 or 11 wherein said terminals are displaced along said elongated body relative to their respective wire fasteners by a distance less than the distance between the axes of the screws of the successive wire fasteners.

13. Electrical apparatus as in any of claims 1, 4, 5, 6 or 7 wherein each said connecting device includes a conductor between the wire fastener and the terminal thereof and wherein each said wire fastener includes a four-sided sheet-metal clamp having two opposite sides disposed perpendicular to said top surface of said elongated body and at a prominent slant angle to said first side of said body, said conductor extending slantwise relative to the elongated body, a portion of said conductor being disposed between said two opposite sides of the clamp, the related screw being threaded through a third side of the clamp and engageable with said portion of said conductor, and the fourth side of the clamp being operable against an inserted wire by tightening of the related screw.

14. Electrical apparatus as in claim 10, wherein each said wire fastener includes a four-sided clamp cooperable with an end portion of a related one of said conductors, two opposite sides of the clamp providing said upright surfaces, a portion of said conductor extending between said two opposite sides of the clamp, the related screw being threaded through a third side of the clamp and being engageable with an end portion of the related conductor, and the fourth side of the clamp being movable against an inserted wire portion when the screw is tightened.

15. Electrical apparatus as in claim 10, wherein said terminals are plug-in terminals adapted to make forcible engagement with a mating plug-in element.

16. Electrical apparatus as in claim 10, wherein said terminals are second wire fasteners having respective upright screws whose axes are parallel to the axes of the first-mentioned screws and which are disposed for endwise engagement by an operating tool from the top of said body of insulation, said terminal block comprising portions defining opposite pairs of upright surfaces extending in planes perpendicular to said top surface and slanting at a prominent angle relative to the first and second sides of the body of insulation for admitting prominently slanted end portions of wires that may extend along said second side of said body of insulation.

* * * * *